United States Patent [19]

Anderson

[11] 4,396,029

[45] Aug. 2, 1983

[54] COIN SORTING APPARATUS AND METHOD

[76] Inventor: Daryl A. Anderson, 2418 N. 78th Ct., Minneapolis, Minn. 55444

[21] Appl. No.: 234,485

[22] Filed: Feb. 17, 1981

[51] Int. Cl.[3] ..... G07D 3/12

[52] U.S. Cl. ..... 133/3 C; 133/3 D

[58] Field of Search ..... 133/3 R, 3 C, 3 D, 3 H, 133/8 R

[56] References Cited

U.S. PATENT DOCUMENTS

| | | | |
|---|---|---|---|
| 2,141,950 | 12/1938 | Colburn et al. | 133/3 D |
| 3,048,251 | 8/1962 | Bower | 133/3 X |
| 4,135,529 | 1/1979 | Onoe et al. | 133/3 C |

*Primary Examiner*—Stanley H. Tollberg
*Attorney, Agent, or Firm*—John W. Adams

[57] ABSTRACT

A coin sorting device which includes an inclined coin transport rail with a coin feeding mechanism for supplying a flow of coins of different sizes to the upper end of the rail, the coin transport rail including at least one drop-through slot opening in the rail for permitting the smallest sized coin to pass therethrough while retaining all of the larger sized coins on the rail and also including a number of spaced apart pickoff coin removing fingers to successively remove selected coins from the rail; the slot being specifically constructed to produce simultaneous tilting and rotation of the smallest coin at the leading end of the slot to insure removal thereof through the slot with all of the coin engaging surfaces of the slot and the fingers being highly polished to reduce friction and obstruction of the flow of coins and certain portions of said surfaces being bevelled to eliminate restriction of the removal of the various coins from the rail, and also the method of sorting and separating coins of different sizes which includes removing through a drop-through slot, the smallest coins from an inclined transport coin carrying rail, and removing the larger sized coins with overhead pickoff fingers and ultimately permitting the next to the smallest coin to be discharged at the lower end of the rail.

13 Claims, 10 Drawing Figures

30a
24

50
40a
51
75
52
78
50a
75a
62

40
40a
41
76
77a
50b
40b
77b
75
50
77c
79
51
51b
52
52b
78
75a
77a
51

COIN SORTING APPARATUS AND METHOD

THE BACKGROUND OF THE INVENTION

This device is an improvement on the coin sorting machine, Model CS1200 manufactured by the Abbott Coin Counter Company, Inc. of Greenwich, CT 06830. The principal problem which exists with the Abbott machine is that the pennies and the dimes are so similar in size that many of the dimes are removed by the pick-off fingers which are intended to remove only the pennies from the inclined transport rail. This has proved to be extremely troublesome for users of the Abbott machine and this invention is intended to greatly improve the selectity of the machine and substantially eliminate this problem. The problem is greatly increased by the fact that all dimes and all pennies are not precisely uniform in diameter so that oversize dimes are difficult to separate from undersized pennies. By providing a drop-through slot opening in the back of the inclined transport rail and making the size of the slot opening sufficiently large to permit even slightly oversized dimes to pass therethrough, the problem of losing dimes in the penny collector portion of the machine can be substantially eliminated. By providing a drop-through slot for removing the smallest coins and permitting the next smallest coin to travel the full length of the rail and be discharged from the lower end thereof and also providing intermediately disposed pickoff fingers for removing coins of larger sizes, a substantially increase in the efficiency of the sorting process can be achieved over the present Abbott machine.

PRIOR ART STATEMENT

The Abbott Model CS1200 is the most pertinent prior art known to applicant at this time. A copy of the instruction manual of said Abbott Model CS1200 machine is included with this application and becomes a part of this disclosure.

SUMMARY OF THE INVENTION

The coin sorter embodying this invention includes an inclined coin transporting rail with means for supplying coins to the upper end of the rail and is provided with a drop-through slot opening for removing the smallest sized coins from the rail, said slot opening being specifically constructed to produce rapid tilting and simultaneous rotation of the smallest coins to insure that the same will all drop therethrough. The larger coins roll past said slot and the next to the smallest sized coins will travel the full length of the rail and be discharged from the lower end thereof. The larger sized coins will be removed by spaced apart pickoff fingers successively positioned along the rail length between said slot and the lower end of said rail.

The method of sorting coins embodied in this invention includes the removal of the smallest sized coins through a drop-through slot opening in the transport rail with the next smallest sized coins being discharged from the lower end of said transport means and removing the larger sized coins by spaced pickoff means positioned along said rail.

The specific aspects of the sorting device embodied in this invention include improvement of the disc-feeding device by providing dropoff recesses between the circumferentially spaced pickup pins of the disc and also providing recesses in the supporting shelf of the inclined transport rail adjacent the pickoff fingers and along a substantial portion of the initial drop-through slot with all of the coin engaging surfaces of the sorting elements being highly polished to substantially reduce the friction produced between the coin and said selective coin engaging surfaces, thus insuring smooth flow of the coins out of the flow path of the transport rail into appropriately segregated compartments.

DESCRIPTION OF THE DRAWINGS

FIG. 6 is an enlarged full scale view of the transport rail assembly as viewed in FIG. 2.

DETAILED DESCRIPTION OF THE PREFERRED EMBODIMENT

Figure 1:
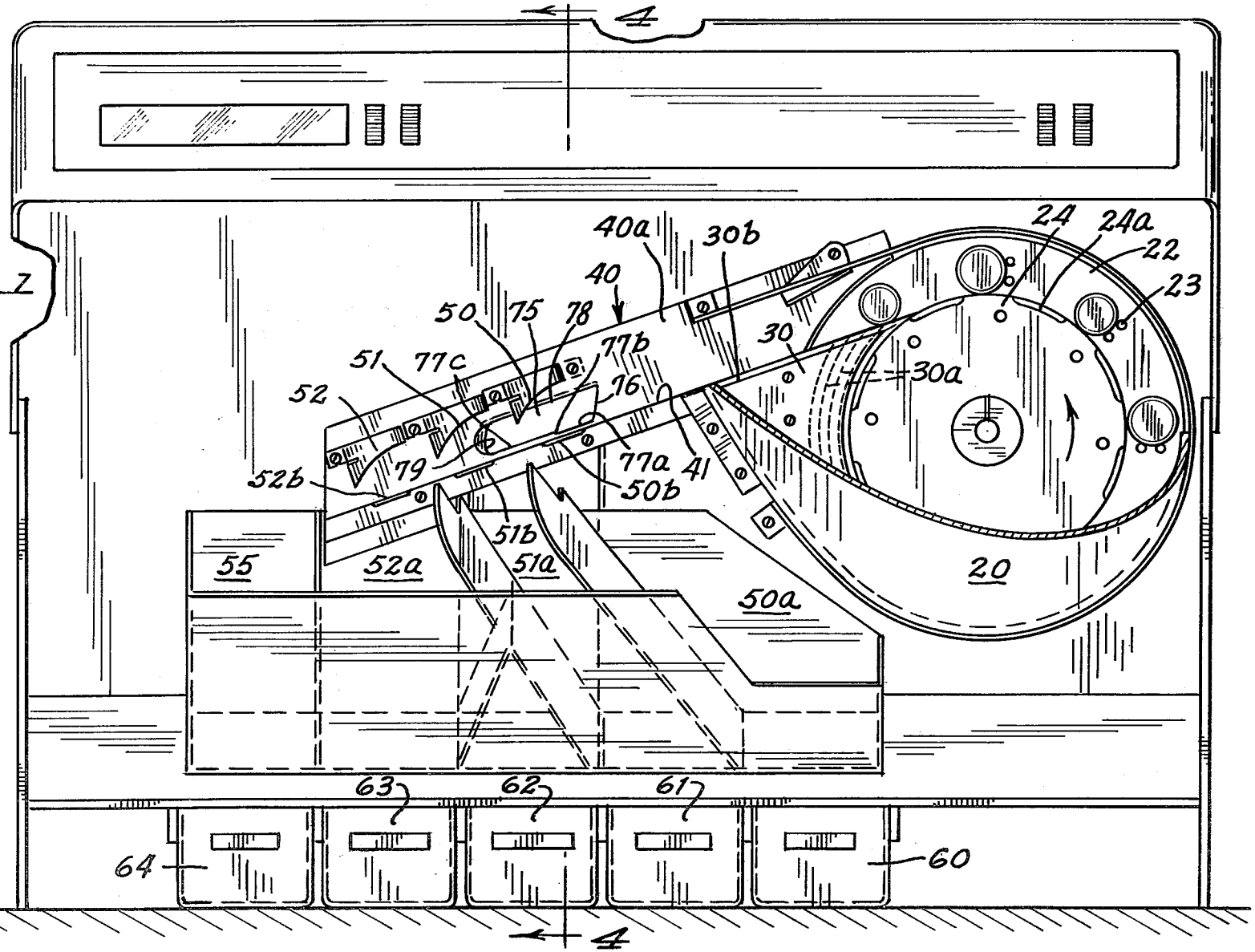
FIG. 1 is a front elevational view of a machine embodying this invention.

In the accompanying drawings, a coin sorting device is illustrated which constitutes an improvement over the Model CS1200 Coin Sorter, manufactured and sold by the Abbott Coin Counter Inc. of Greenwich, CT. The details of the Abbott machine are set forth in the instruction manual which is supplied herewith as a part of the present disclosure.

The coin sorter embodying this invention includes a coin hopper 20 into which the coins to be sorted are dumped. A rotating pickup disk 22 is mounted with its lower portion adjacent to and enclosed by said hopper 20. The pickup disk is tilted rearwardly so that coins may be carried upwardly out of the hopper by the pickup pins 23 fixed in outstanding relation to the face of the disk 22 as illustrated. The disk includes a generally circular pickup ridge 24 fixed to the face of the disk and having a diameter somewhat smaller than the outer diameter of the disk to provide a generally circular inclined outer marginal supporting surface **22*a* adjacent to the pickup pins 23**.

The pins 23 pick up the coins from the hopper and combine with the outer surface **22*a* to transfer the coins up around the upper portion of the disk as shown in the drawings and deliver the coins to a stationary transport rail extension 30 which overlies the outer surface portion 22*a* of the disk. The pins 23 travel under the plate 30 through grooves 30*a* provided therein and the coins are removed from the pickup pins 23 and roll down an inclined rail extension shelf 30*b***.

Figures 2, 3:
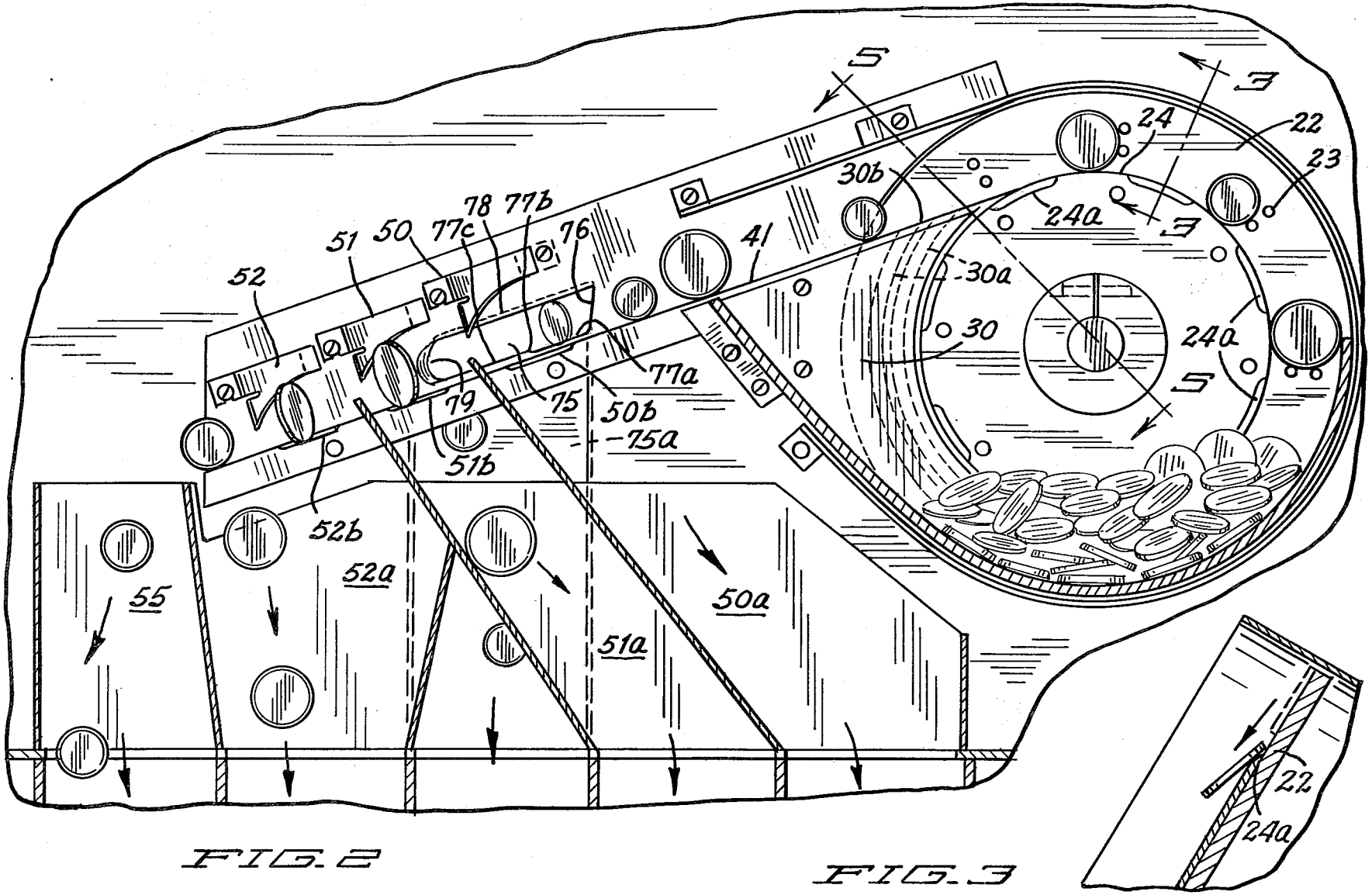
FIG. 2 is a longitudinal sectional view through the machine with the plane of the section being disposed immediately in front of the plane of the feeding disc and transport rail.
FIG. 3 is a fragmentary sectional view taken substantially along the line 3—3 of FIG. 2.
Figures 4, 5:
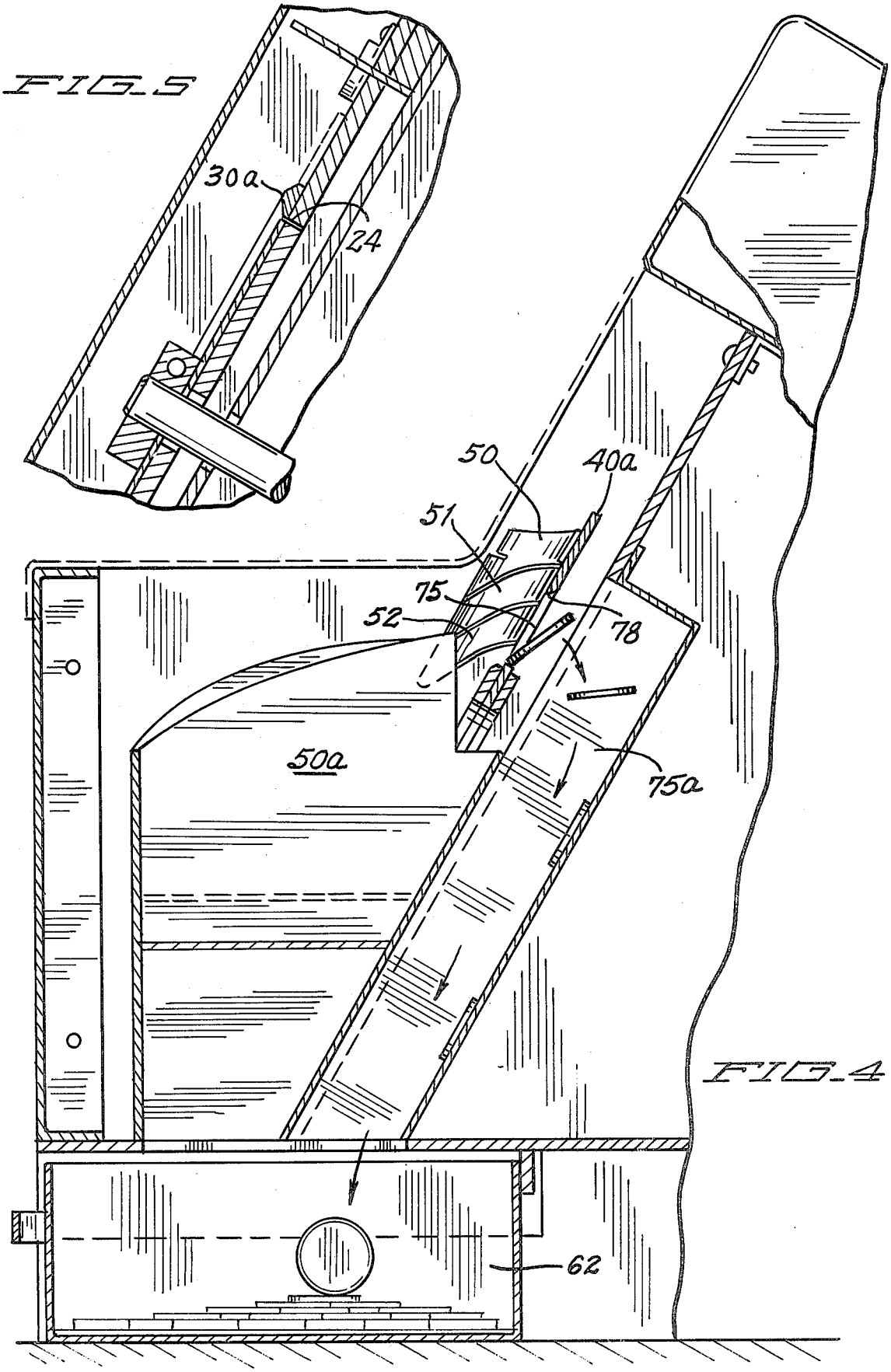
FIG. 4 is a transverse vertical sectional view taken sustantially along the line 4—4 of FIG. 1.
FIG. 5 is a fragmentary sectional view taken substantially along the line 5—5 of FIG. 2.
Figures 7, 8, 9, 10:
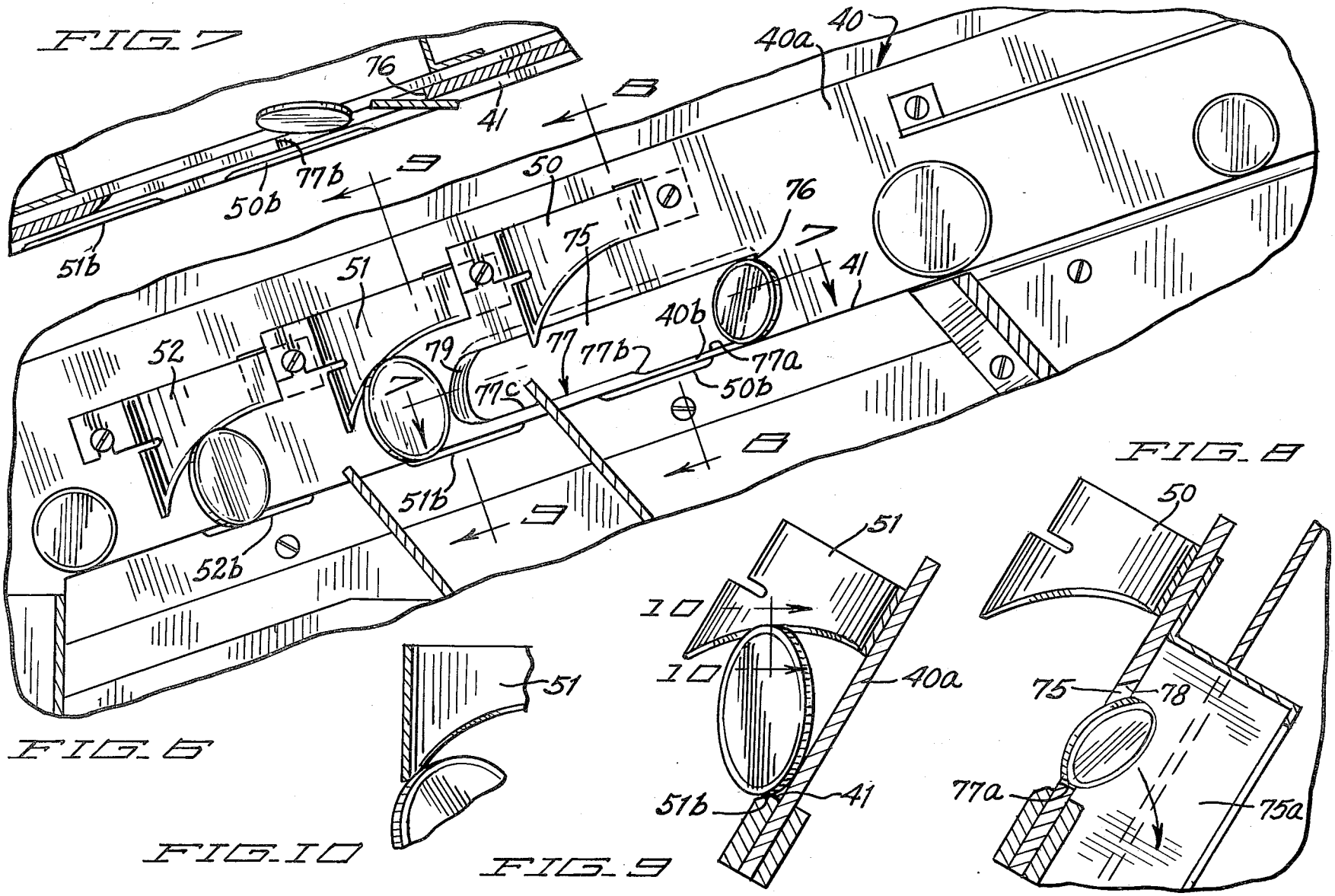
FIG. 7 is a fragmentary section view taken substantially along the line 7—7 of FIG. 6.
FIG. 8 is a fragmentary sectional view taken substantially along the line 8—8 of FIG. 6.
FIG. 9 is a fragmentary sectional view taken substantially along the line 9—9 of FIG. 6.
FIG. 10 is a fragmentary sectional view taken substantially along the line 10—10 of FIG. 9.

A sorting transport rail 40 extends in inclined relation downwardly from the rail extension shelf **30*b* and is also tilted back at substantially the same angle as the disk 22 in order to carry the coins down the rail away from the pickup disk. The rail 40 includes a lower coin-engaging shelf 41 which is aligned with the rail extension shelf 30***b*. A plurality of spaced pickoff fingers such as the outwardly curved fingers 50, 51 and 52 are fixed to the rail 40 and are designed to engage and remove the larger sized coins from the rail as they travel therealong. The removed coins are guided into separate chutes respectively designated 50*a*, 51*a* and 52*a* as best shown in FIGS. 1 and 2 and are carried into the respective segregated compartments such as the collection trays 60, 61, 62, 63 and 64. As the larger sized coins engage the curved camming surfaces of the pickoff fingers 50, 51 and 52 they are respectively removed from the rail 40 and discharged into the trays 60, 61 and 63. The second from the smallest coins, the pennies in the U.S. denomination system, travel the full length of the rail 40 and are discharged at the end thereof into an end guiding chute 55 and into the collection tray 64.

In the form shown the smallest coins (the dimes) are removed by a drop-through slot opening 75 which is provided in the back member 40*a* of the inclined rail 40. The slot has an upper or leading end 76, a bottom edge 77, a top edge 78 and a lower or trailing end 79. The bottom edge 77 of the slot opening 75 is cut away to provide a recess 77*a* which extends downstream from the leading end 76 of the slot a distance substantially equal to approximately 1½ diameters of the coin passing therethrough. The trailing or lower end 77*b* of the recess 77*a* is beveled upwardly so that the dime as it rolls down the shelf 41 will ride up on the top edge of the recess 77*a* until it reaches the beveled end 77*b* of said recess. The end of the recess 77*b* is smoothly contoured as best shown in FIG. 6 and as the dime engages the contoured beveled surface it will be "kicked" up through the slot opening 75. The top longitudinal edge 78 of the slot 75 is beveled back from the front side to the back side thereof so if the upper edge of the dime strikes the top edge 78 of the slot 75 it will be positively cammed back through the slot as it is kicked up by the beveled end 77*b* of the recess 77*a*. The upper or leading end 76 of the slot 75 is sloped toward the feeding end of rail 40 so that the upper portion of the dime traveling down the rail will immediately start to rotate on its upstanding axis simultaneously with its initial tilting action back through the upper portion of the slot opening 75. This simultaneous rotation and rearward tilting action of the coin causes the upper portion thereof to pass quickly and positively through the slot opening 75 behind the front face of the upper edge 78 so that as the lower edge of the coin engages the beveled camming end 77*b* of the recess 77*a* the coin will be immediately and positively cammed through said slot 75 with the rearwardly beveled edge 78 assisting in the rearward camming of the upper portion of the coin, if necessary.

The upper edge 78 of the slot opening 75 is spaced above the shelf 41 a greater distance than the diameter of the coins which are destined to pass through the slot (the dimes in the instant disclosure) to permit the upper portion of said coins to immediately begin to fall back through the slot 75 as they pass the rearwardly sloped leading end 76 of said slot. The width of the slot 75 above the recess 77*a* is substantially equal to the diameter of the dimes and the width of the portion 77*c* of the slot downstream of the lower end 77*b* of the recess 77*a* is slightly less than the diameter of said dimes. There is a sufficient retaining shoulder 40*b* provided below the recess 77*a* to keep the lower edge of the pennies and the larger sized coins on the rail shelf 41 as they roll past the slot opening 75. The trailing or downstream end 79 of the slot 75 is smoothly beveled from the back to the front surface of back member 40*a* to provide a beveled front surface of the back member 40*a* extending downstream from the downstream end 79 of the slot 75. The end 79 is also curved, as viewed in front elevation and shown in FIGS. 1 and 6. This prevents the possibility of pennies or other larger coins from being obstructed by engagement against the end 79 of the slot 75 and also prevents the dimes from being jammed in crosswise position if engaged by the following larger coins traveling down the rail shelf 41. After the dimes pass through the slot opening 75 they fall through a chute 75*a* behind the chute 51*a* and down into the collection tray 62 as best shown in FIG. 1.

The pickoff fingers 50, 51 and 52 have smoothly polished beveled coin engaging camming surfaces to minimize the resistance of the coins engaged therewith. Also the portions of the shelf 41 disposed immediately below the curved camming surfaces of said pickoff fingers are beveled to provide relief recesses 50*b*, 51*b* and 52*b* to permit the coins engaged by the respective overhead fingers to drop away without restriction as soon as they are cammed away from the back member 40*a* by engagement with the respective fingers 50, 51 and 52. The portion of the shelf remaining behind each of the recesses 50*b*, 51*b* and 52*b* is of sufficient width to support the pennies and the larger coins as they roll down the rail.

It will be noted that the circular coin pickup ridge 24 of the rotating coin pickup disk 22 has a plurality of beveled coin release recess portions 24*a* in spaced relation ahead of each pair of pins 23 by a distance slightly greater than the radius of the largest coin being sorted. This will prevent more than one coin at a time from being transported by each set of pins 23 onto the rail extension shelf 30*b*. In other words these recess portions 24*a* are designed so that no coins can be supported at those portions of the ridge 24 and this will insure that the coins will be delivered to the rail extension shelf 30*b* one at a time.

As indicated by the instruction manual of the prior art Abbott device, said Abbott device uses a rotating coin pickup disk and ridge assembly similar to that disclosed herein except for the provision of the coin release recess portions 24*a*. The Abbott device also employs an inclined rail assembly but instead of using the drop through slot 75 in combination with the pickoff fingers 50, 51 and 52 embodied in this invention, said Abbott device embodies only spaced pickoff fingers generally similar to the fingers 50, 51 and 52 except for the relief recesses 50*b*, 51*b* and 52*b*. The problem with this construction is that the pickoff finger for the pennies frequently remove the dimes also as has been stated previously herein. The combination of the drop through slot 75 for the smallest sized coins with the pickoff fingers permits coins of very similar size denominations to be accurately separated and eliminates this problem. It should be pointed out that while the present device shows only three pickoff fingers, that an additional pickoff finger could be provided for the Anthony dollar coins introduced recently into the United States coin denominations and it will also be apparent that the present invention is well adapted for a retrofit modification for the present Abbott device in use as well as a new machine embodying the sorting rail assembly disclosed herein.

What is claimed is:

1. A coin-sorting device comprising, a downwardly inclined coin-carrying rail, a coin feeding mechanism for feeding coins one at a time onto the upper end of said rail, said rail being tilted rearwardly and including a back member for slidably engaging the back face of the coins traveling down said rail, said rail also including a forwardly extending coin carrying shelf fixed along the lower portion thereof and being sufficiently wide to support the circumferential edge of the coins rolling along said rail, said back member having a drop-through slot opening positioned along the length of said rail, the size of said slot opening being sufficiently wide to permit the smallest of the coins to pass therethrough and having the leading end of the slot sloping toward the upper end of said rail to cause said smallest sized coins to substantially simultaneously tilt into the slot and rotate on their upstanding axes to insure quick passage of said smallest coins through said slot opening, the lower edge of said slot being spaced above said shelf to provide a retaining flange for a substantial portion of the length of said slot to positively maintain the lower edges of the larger coins on said shelf, means for removing the larger coins from said rail, said flange being cut away adjacent the leading end of the slot to reduce the height thereof and thereby reduce the resistance to initial tilting and rotation of the smallest coins as they begin their passage through the slot opening, the length of said cut away portion of said flange being sufficient to produce the desired quick exit of the smallest coins through the slot opening without reducing the stability of the larger coins rolling down said rail, and the downstream end of said cut away portion being bevelled to engage and "kick" up a coin riding on the cut away portion to positively project the coin rearwardly as the same is falling through the slot.

2. The structure set forth in claim 1 wherein the length of said cut away portion of the flange being not less than the diameter of the smallest coin and not more than one and one-half diameters of the smallest coin.

3. The structure set forth in claim 1 wherein the trailing end of said slot opening is smoothly beveled from the front side toward the back side to positively prevent engagement of the larger sized coins with said trailing end.

4. The structure set forth in claim 3 and the trailing end of said slot being curved as viewed in front elevation.

5. The structure set forth in claim 1 wherein the top edge of said slot opening is beveled upwardly from the front edge of the back to prevent restriction by the smallest coins as they are passing through the slot.

6. The structure set forth in claim 1 and a plurality of top engaging curved camming fingers spaced apart along the length of said rail and spaced above said shelf progressively diminishing distances for successive engagement with the larger sized coins as they travel along the rail to remove the larger sized coins from the rail at different locations along the length thereof.

7. The structure set forth in claim 6 wherein the lower edges of said fingers are curved and smoothly rounded to provide minimal frictional resistance to engagement of the rolling coins.

8. The structure set forth in claim 1 and said coin feeding mechanism including a rotary pickup disk having spaced apart pickup pins extending forwardly from the face thereof and a ridge having a radius slightly smaller than the radial spacing of the pins from the center of the disk, and said ridge having beveled recessed portions in forwardly spaced relation to said pins to prevent more than one coin from being retained by each set of pins at a time.

9. A coin-sorting device comprising a downwardly inclined coin-carrying rail, a coin feeding mechanism for feeding coins one at a time onto the upper end of said rail, said rail being tilted rearwardly and including a back member for slidably engaging the back face of the coins traveling down said rail, said rail also including a forwardly extending coin-carrying shelf fixed along the lower portion thereof and being sufficiently wide to support the circumferential edge of the coins rolling along said rail, a plurality of pickoff fingers spaced along said rail and spaced above said shelf in progressively decreasing distances to progressively remove the larger sized coins from the rail, the portions of the shelf respectively disposed below said pickoff fingers being recessed to substantially reduce the resistance to removal of the coins respectively engaged by said fingers, and means for collecting the respective sorted coins in segregated compartments.

10. The structure set forth in claim 9 and said coin feeding mechanism including a rotary pickup disk having spaced apart pickup pins extending forwardly from the face thereof and a ridge having a radius slightly smaller than the radial spacing of the pins from the center of the disk, and said ridge having beveled recessed portions in forwardly spaced relation to said pins to prevent more than one coin from being retained by each set of pins at a time.

11. A coin-sorting device comprising, a downwardly inclined coin-carrying rail, a coin feeding mechanism for feeding coins one at a time onto the upper end of said rail, said rail being tilted rearwardly and including a back member for slidably engaging the back face of the coins traveling down said rail, said rail also including a forwardly extending coin-carrying shelf fixed along the lower portion thereof and being sufficiently wide to support the circumferential edge of the coins rolling along said rail, said back member having a drop-through slot opening positioned along the length of said rail, the size of said slot opening being sufficiently wide to permit the smallest of the coins to pass therethrough and having the leading end of the slot sloping toward the upper end of said rail to cause said smallest sized coins to substantially simultaneously tilt into the slot and rotate on their upstanding axes to insure quick passage of said smallest coins through said slot opening, the lower edge of said slot being spaced above said shelf to provide a retaining flange for a substantial portion of the length of said slot to positively maintain the lower edges of the larger coins on said shelf, a plurality of top engaging curved camming fingers spaced apart along the length of said rail and spaced above said shelf progressively diminishing distances for successive engagement with the larger sized coins as they travel along the rail to remove the larger sized coins from the rail at different locations along the length thereof, and the portions of the shelf respectively disposed below the camming edges of the fingers are recessed to reduce the resistance to removal of the larger coins as they are respectively engaged by said fingers.

12. The method of sorting coins of different sizes comprising, supplying the coins to be sorted to the upper end of an inclined coin carrying rail having a coin supporting shelf and a back member which is tilted back to maintain the rolling coins on said shelf, providing a slot opening in the back member to permit the smallest coins being sorted to be removed therethrough, removing the larger coins successively by a plurality of overhead fingers spaced along said rail, collecting the coins from the respective fingers and the slot opening to segregate said coin sizes, and providing a recess at the leading end portion of the slot with a camming shoulder at the end of the recess to kick up the coins as they are falling back through the slot and positively eject the coins rearwardly through said slot opening.

13. The method set forth in claim 12 and substantially eliminating the resistance to removal of the coins by said fingers, by reducing the thickness of the portion of the coin supporting shelf immediately below said spaced apart fingers.

* * * * *